US010870940B2

(12) United States Patent
Boutiette

(10) Patent No.: US 10,870,940 B2
(45) Date of Patent: Dec. 22, 2020

(54) WASHING MACHINE APPLIANCE AND METHODS FOR MOISTURE REMOVAL

(71) Applicant: Haier US Appliance Solutions, Inc., Wilmington, DE (US)

(72) Inventor: Todd Boutiette, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 443 days.

(21) Appl. No.: 15/927,175

(22) Filed: Mar. 21, 2018

(65) Prior Publication Data

US 2019/0292705 A1 Sep. 26, 2019

(51) Int. Cl.

| | |
|---|---|
| ***D06F 25/00*** | (2006.01) |
| ***D06F 33/00*** | (2020.01) |
| ***D06F 35/00*** | (2006.01) |
| ***D06F 39/14*** | (2006.01) |
| ***D06F 58/38*** | (2020.01) |
| ***E05F 15/611*** | (2015.01) |
| *D06F 103/08* | (2020.01) |
| *D06F 103/36* | (2020.01) |
| *D06F 105/24* | (2020.01) |

(52) U.S. Cl.

CPC ..... *D06F 25/00* (2013.01); *D06F 33/00* (2013.01); *D06F 35/005* (2013.01); *D06F 39/14* (2013.01); *D06F 58/38* (2020.02); *D06F 2103/08* (2020.02); *D06F 2103/36* (2020.02); *D06F 2105/24* (2020.02); *E05F 15/611* (2015.01); *E05Y 2900/312* (2013.01)

(58) Field of Classification Search

CPC ..... D06F 25/00; D06F 33/00; D06F 35/005; D06F 39/14; D06F 58/38; D06F 2103/08; D06F 2103/36; D06F 2105/24; D06F 2202/10; D06F 2202/12; D06F 2204/06; D06F 2204/10; E05F 15/611; E05Y 2900/312

USPC ..... 8/158, 159; 68/12.01, 12.26, 13 R, 20

See application file for complete search history.

(56) References Cited

U.S. PATENT DOCUMENTS

| | | | | |
|---|---|---|---|---|
| 5,838,125 | A | 11/1998 | Choi | |
| 8,984,692 | B2 | 3/2015 | Balinski et al. | |
| 9,689,100 | B2 | 6/2017 | Balinski et al. | |
| 2015/0337475 | A1* | 11/2015 | Balinski | D06F 25/00 8/137 |

* cited by examiner

*Primary Examiner* — Levon J Shahinian

(74) *Attorney, Agent, or Firm* — Dority & Manning, P.A.

(57) ABSTRACT

A washing machine appliance equipped with features for performing a moisture removal cycle is provided. When performing a moisture removal cycle, a door or lid of the washing machine appliance is moved to an open position so that moisture may be removed from a wash fluid compartment defined by a tub of the washing machine appliance. Methods for operating the washing machine appliance in a moisture removal cycle are also provided.

18 Claims, 6 Drawing Sheets

WASHING MACHINE APPLIANCE AND METHODS FOR MOISTURE REMOVAL

FIELD OF THE INVENTION

The present disclosure relates generally to washing machine appliances and more particularly to washing machine appliances equipped with moisture removal features.

BACKGROUND OF THE INVENTION

Washing machine appliances generally include a drum or basket rotatably mounted within a tub of a cabinet. The basket defines a wash chamber for receiving articles for washing. During operation, wash fluid is directed into the tub and onto articles within the wash chamber. A motor can rotate the basket at various speeds to agitate articles within the wash chamber in wash fluid, to wring wash fluid from articles within the wash chamber, etc.

After completion of a cycle of operation, the laundry articles may still contain moisture and there may still be moisture within the wash chamber and the tub. This moisture can become trapped and may cause mold, mildew and/or odor issues, which many consumers find unpleasant. Some conventional washing machine appliances are configured to perform venting cycles for removing the moisture from the laundry articles, wash chamber, and tub. However, such venting cycles have been largely unsatisfactory as high humidity levels within the wash chamber and tub typically persist even after such venting cycles are run.

Therefore, a washing machine appliance and methods for removing moisture from the wash chamber and tub that address one or more of the challenges noted above would be useful.

BRIEF DESCRIPTION OF THE INVENTION

Aspects and advantages of the invention will be set forth in part in the following description, or may be apparent from the description, or may be learned through practice of the invention.

One aspect of the present disclosure is directed to a method for operating a washing machine appliance in a moisture removal cycle. The method includes receiving a signal indicative of a relative humidity of air within a wash fluid compartment defined by a tub. The method also includes determining whether the relative humidity of air within the wash fluid compartment is greater than a relative humidity threshold based at least in part on the signal. Further, the method includes opening, if the relative humidity of air within the wash fluid compartment is greater than the relative humidity threshold, a door of the washing machine appliance to an open position to flow ambient air into the wash fluid compartment.

Another aspect of the present disclosure is directed to a washing machine appliance configured for performing a moisture removal cycle. The washing machine appliance includes a cabinet and a tub disposed within the cabinet and defining a wash fluid compartment. The washing machine appliance also includes a basket rotatably mounted within the tub, the basket defining a wash chamber for receipt of articles for washing. Further, the washing machine appliance includes a lid coupled with the cabinet and movable between an open position and a closed position for selectively providing access to the wash chamber. In addition, the washing machine appliance includes a motor operatively coupled with the lid and configured for moving the lid between the open position and the closed position. Moreover, the washing machine appliance includes a humidity sensor mounted to the washing machine appliance within the wash fluid compartment. The washing machine appliance also includes a controller in operative communication with the motor and the humidity sensor. The controller configured to: receive a signal from the humidity sensor that is indicative of a relative humidity of air within the wash fluid compartment; determine whether the relative humidity of air within the wash fluid compartment is greater than a relative humidity threshold; and activate, if the relative humidity of air within the wash fluid compartment is greater than the relative humidity threshold, the motor to move the lid to the open position to flow ambient air into the wash fluid compartment.

Yet another aspect of the present disclosure is directed to a method for operating a washing machine appliance in a moisture removal cycle. The method includes receiving a signal indicative of a relative humidity of air within a wash fluid compartment defined by a tub. The method also includes receiving a signal indicative of a relative humidity of ambient air external to the wash fluid compartment. Further, the method includes determining whether the relative humidity of air within the wash fluid compartment is greater than the relative humidity of ambient air external to the wash fluid compartment. Moreover, the method includes opening, if the relative humidity of air within the wash fluid compartment is greater than the relative humidity of ambient air external to the wash fluid compartment, a door of the washing machine appliance to an open position to flow ambient air into the wash fluid compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
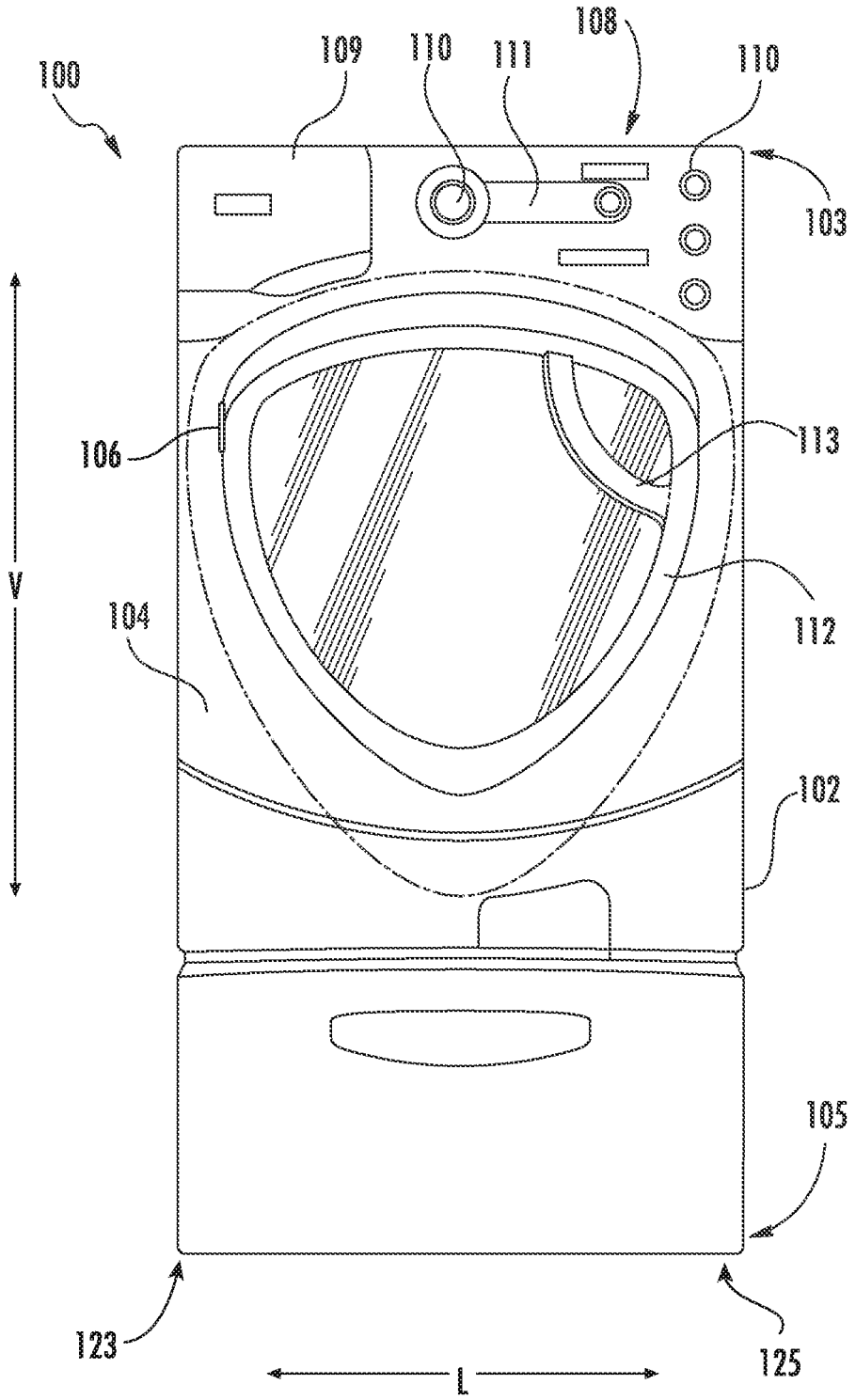
FIG. 1 provides a front, elevation view of a washing machine appliance according to an exemplary embodiment of the present disclosure and depicts a door of the washing machine appliance in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
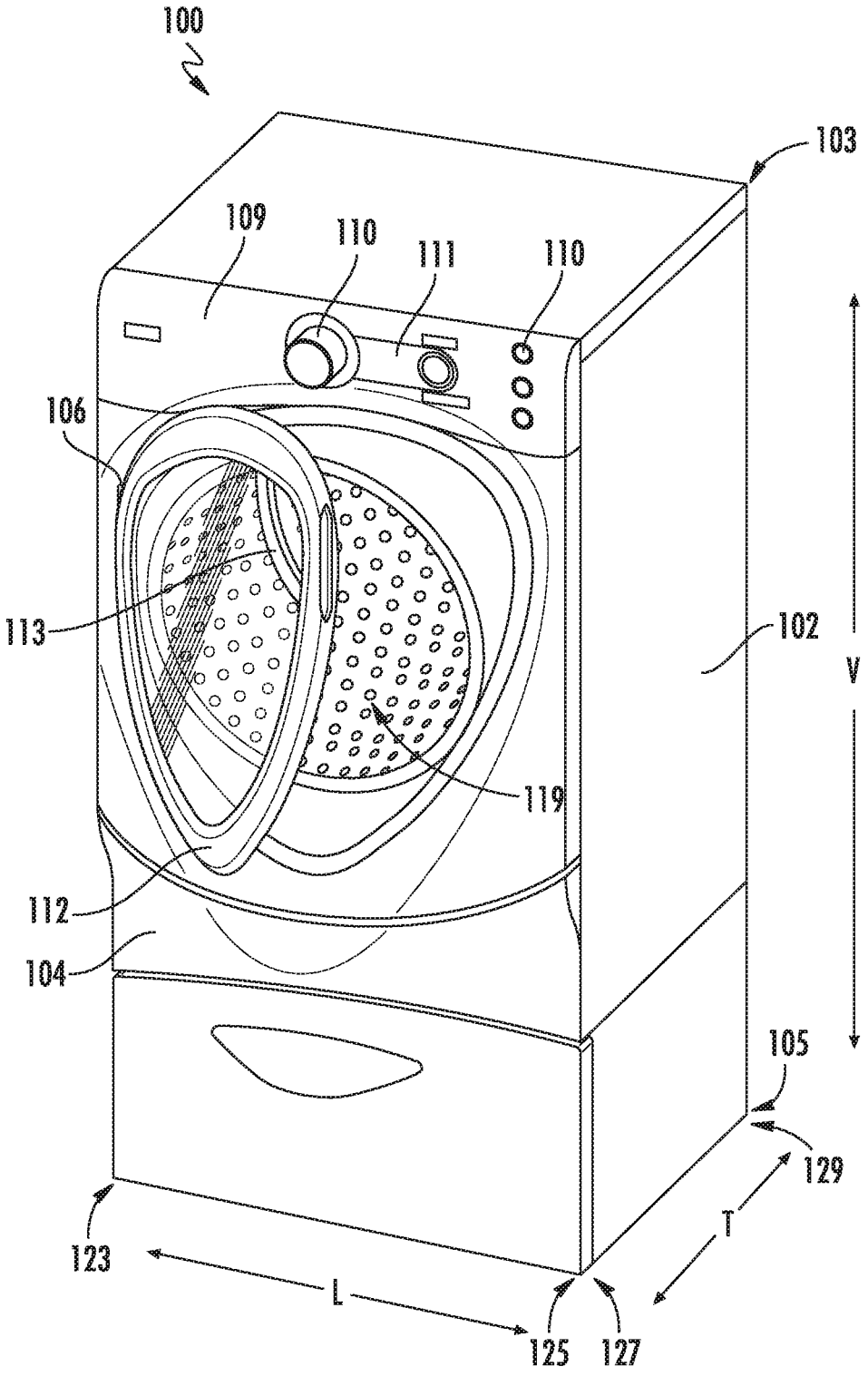
FIG. 2 provides a front, perspective view of the washing machine appliance of FIG. 1 and depicts the door of the washing machine appliance in an open position.
Figure 3:
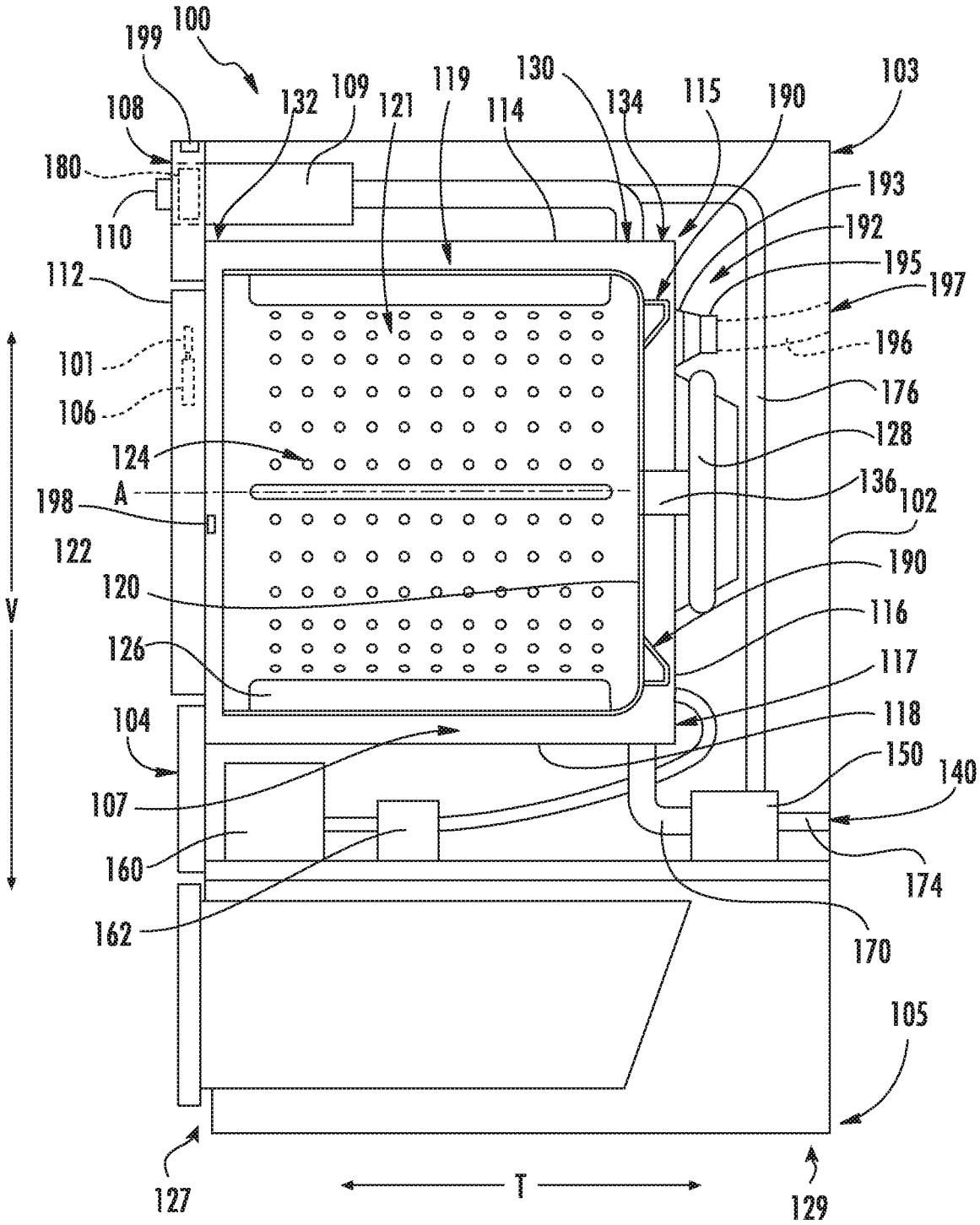
FIG. 3 provides a side, section view of the exemplary washing machine appliance of FIG. 1.

FIGS. 1, 2, and 3 provide views of an exemplary front load or horizontal axis washing machine appliance 100. In particular, FIG. 1 provides a front, elevation view of washing machine appliance 100 with a door 112 in a closed position, FIG. 2 provides a front, perspective view of washing machine appliance 100 with door 112 in an open position, and FIG. 3 provides a side, section view of washing machine appliance 100. As shown, washing machine appliance 100 includes a cabinet 102 that extends between a top portion 103 and a bottom portion 105, e.g., along a vertical direction V. Cabinet 102 also extends between a first side 123 and a second side 125, e.g., along a lateral direction L, and between a front 127 and a rear 129 (FIG. 3), e.g., along a transverse direction T. The vertical, lateral, and transverse directions V, L, T defined by washing machine appliance 100 are mutually perpendicular and together define an orthogonal direction system.

While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well, including, for example, vertical axis washing machine appliances. Thus, the teachings of the present disclosure are not limited to use with washing machine appliance 100.

Cabinet 102 includes a front panel 104. Door 112 is mounted to front panel 104 and is rotatable about a hinge assembly 106, e.g., about the vertical direction V, between an open position (FIG. 2) facilitating access to a wash drum or basket 120 located within cabinet 102 and a closed position (shown in FIGS. 1 and 3) hindering access to basket 120. A user may pull on a handle 113 in order to adjust door 112 between the open position and the closed position. In accordance with exemplary aspects of the present disclosure, washing machine appliance 100 includes a motor 101 (FIG. 3) operatively configured to selectively and automatically open and close door 112, e.g., upon an activation command from a controller of washing machine appliance 100. That is, motor 101 is configured to drive or move door 112 between the open position (FIG. 2) and the closed position (FIGS. 1 and 3). For this embodiment, motor 101 is in mechanical communication with hinge assembly 106 to drive or move door 112 between the open and closed positions.

A control panel 108 including a plurality of input selectors 110 is coupled to front panel 104. Control panel 108 and input selectors 110 collectively form a user interface input for operator selection of machine cycles and features. For example, in one embodiment, a display 111 (FIG. 1) indicates selected features, a countdown timer, and/or other items of interest to machine users.

As shown in FIG. 3, a tub 114 defines a wash fluid compartment 119 configured for receipt of a washing fluid. Thus, tub 114 is configured for containing washing fluid, e.g., during operation of washing machine appliance 100. Washing fluid disposed within tub 114 may include at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of appliance 100. For example, during operation of appliance 100, washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 3) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 is directed out of appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine appliance 100 as described below. In particular, a shaft 136 mechanically couples motor 128 with basket 120 and drivingly rotates basket 120 about a shaft or central axis A, e.g., during a spin cycle. Ribs 126 extend from basket 120 into wash chamber 121. Ribs 126 assist agitation of articles disposed within wash chamber 121 during operation of washing machine appliance 100. For example, ribs 126 may lift articles disposed in basket 120 during rotation of basket 120.

A drawer 109 is slidably mounted within front panel 104. Drawer 109 receives a fluid additive (e.g., detergent, fabric softener, bleach, or any other suitable liquid) and directs the fluid additive to wash fluid compartment 119 during operation of washing machine appliance 100. Additionally, a reservoir 160 is disposed within cabinet 102. Reservoir 160 is also configured for receipt of fluid additive for use during operation of washing machine appliance 100. Reservoir 160 is sized such that a volume of fluid additive sufficient for a plurality or multitude of wash cycles of washing machine appliance 100 may fill reservoir 160. Thus, for example, a user can fill reservoir 160 with fluid additive and operate washing machine appliance 100 for a plurality of wash cycles without refilling reservoir 160 with fluid additive. A reservoir pump 162 is configured for selective delivery of the fluid additive from reservoir 160 to tub 114.

Also shown in FIG. 3 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 3, any number of such rings or apparatuses can be included in washing machine appliance 100 and can be placed according to any known or desirable configuration. For example, two balancing rings can be respectively placed at the front and back of basket 120.

As further depicted in FIG. 3, for this embodiment, washing machine appliance 100 includes a humidity sensor 198 for sensing the humidity within wash fluid compartment 119, which includes wash chamber 121. Humidity sensor 198 may be positioned in any suitable location within wash fluid compartment 119. For this embodiment, humidity sensor 198 is mounted to an inner side of door 112. In other embodiments, humidity sensor 198 is mounted to an inner side of cover 104. Humidity sensor 198 may be any suitable sensor capable of sensing the humidity or relative humidity within wash fluid compartment 119. For instance, humidity sensor 198 may be a capacitive, resistive, or thermal sensor. As will be explained in further detail below, humidity sensor 198 is configured to sense the humidity within wash fluid compartment 119, and based at least in part on the signals from humidity sensor 198, motor 101 may be activated to move door 112 to an open position. In this way, moisture within wash fluid compartment 119 may be removed. That is, when door 112 is moved to an open position, ambient air, which is likely drier and at a higher pressure than the air within wash fluid compartment 119, flows into wash fluid compartment 119 and displaces the moist, low pressure air from wash fluid compartment 119. In this way, moisture may be removed from wash fluid compartment 119.

In some embodiments, washing machine appliance 100 includes an ambient humidity sensor 199 for sensing the humidity and/or relative humidity of the ambient conditions of the air external to wash fluid compartment 119. Ambient humidity sensor 199 may be positioned in any suitable location. For this embodiment, ambient humidity sensor 199 is mounted proximate top 103 of cabinet 102. Ambient humidity sensor 199 may be any suitable sensor capable of sensing the humidity or relative humidity of the ambient air external to the wash fluid compartment 119. For instance, ambient humidity sensor 199 may be a capacitive, resistive, or thermal sensor. As will be explained in further detail below, signals from ambient humidity sensor 199 may be utilized to make decisions as to whether door 112 should be automatically opened or closed to remove moisture from wash fluid compartment 119.

In addition, in some embodiments, washing machine appliance 100 includes a ventilation assembly 192 that is configured to actively remove moisture from wash fluid compartment 119. Ventilation assembly 192 includes a fan 195 positioned at or proximate rear 134 of tub 114 and a fluid supply conduit 196 in fluid communication with fan 195 and the exterior of washing machine appliance 100. In some embodiments, fan 195 may be used to draw ambient air through an opening 197 defined by cabinet 102 and along fluid supply conduit 196 so that the ambient air may flow into wash fluid compartment 119. A sealable damper 193 movable between an open and closed position may selectively allow ambient air into wash fluid compartment 119. In some embodiments, fan 195 may be activated when door 112 is opened to facilitate movement of the moist, relatively low pressure air within wash fluid compartment 119 toward front 132 of tub 114 and ultimately out of wash fluid compartment 119 as the likely drier, high pressure air rushed into wash chamber compartment 119. In some embodiments, when door 112 is moved to an open position to remove moisture from wash fluid compartment 119, fan is not activated. Further, in some embodiments, washing machine appliance 100 does not include ventilation assembly 192.

Operation of washing machine appliance 100 is controlled by a processing device or controller 180 that is operatively coupled to control panel 108 for user manipulation to select washing machine cycles and features. In response to user manipulation of control panel 108, controller 180 operates the various components of washing machine appliance 100 to execute selected machine cycles and features.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 108 and other components of washing machine appliance 100 may be in communication with controller 180 via one or more signal lines or shared communication busses.

Controller 180 is in operative communication with motor 128. Thus, controller 180 can selectively activate and operate motor 128, e.g., depending upon a wash cycle selected by a user of washing machine appliance 100. Controller 180 may also be configured for monitoring a power delivered to motor 128. As will be understood by those skilled in the art, power delivered to motor 128 can be measured or determined by controller 180 utilizing various methods. Further, controller 180 may further be configured for determining a current speed of motor 128 according to any known techniques. For example, a speed signal describing the current speed of the motor can be created and provided to controller 180 according to back electromotive force techniques or based on the output of one or more sensors or other components including, for example, an optical sensor or magnetic-based sensors such as hall effect sensors.

In addition, for this embodiment, controller 180 is also in operative communication with humidity sensor 198, ambient humidity sensor 199, fan 195, damper 193, and motor 101. Accordingly, controller 180 may receive signals from and rout signals to these various components. For instance, controller 180 may receive signals from humidity sensor 198 that are indicative of the humidity or relative humidity of the air within wash fluid compartment 119. Further, controller 180 may receive signals from ambient humidity sensor 199 indicative of the humidity or relative humidity of the ambient air external to wash fluid compartment 119. Such signals may be used to make decisions as to whether to activate motor 101 to move door 112 to an open positioned to facilitate moisture removal from wash fluid compartment 119. Controller 180 can receive the signals directly or indirectly from sensors 198, 199. Moreover, controller 180 may send signals to motor 101, e.g., to move door 112, to fan 195, e.g., to blow air within wash fluid compartment 119 or draw in ambient air, or controller 180 may send signals to damper 193 to open or close.

In an illustrative example of operation of washing machine appliance 100 in a wash cycle, laundry items are loaded into basket 120, and washing operation is initiated through operator manipulation of input selectors 110. Tub 114 is filled with water and detergent to form a wash fluid. One or more valves (not shown) can be actuated by controller 180 to provide for filling tub 114 to the appropriate level for the amount of articles being washed. Once tub 114 is properly filled with wash fluid, the contents of basket 120 are agitated with ribs 126 for cleansing of laundry items in basket 120.

After the agitation phase of the wash cycle is completed, tub 114 is drained. Laundry articles can then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, basket 120 is rotated at relatively high speeds.

After completion of the wash cycle, as noted previously, moisture can become trapped in wash fluid compartment 119. This may cause mold and mildew to spread onto the components of washing machine appliance 100 and onto the laundry articles within basket 120. Odors may likewise arise. Accordingly, in accordance with exemplary aspects of the present disclosure, after or between such wash cycles, washing machine appliance 100 may be operated in a moisture removal cycle to remove moisture from within wash fluid compartment 119. An exemplary method for performing such a cycle is provided below.

Figure 4:
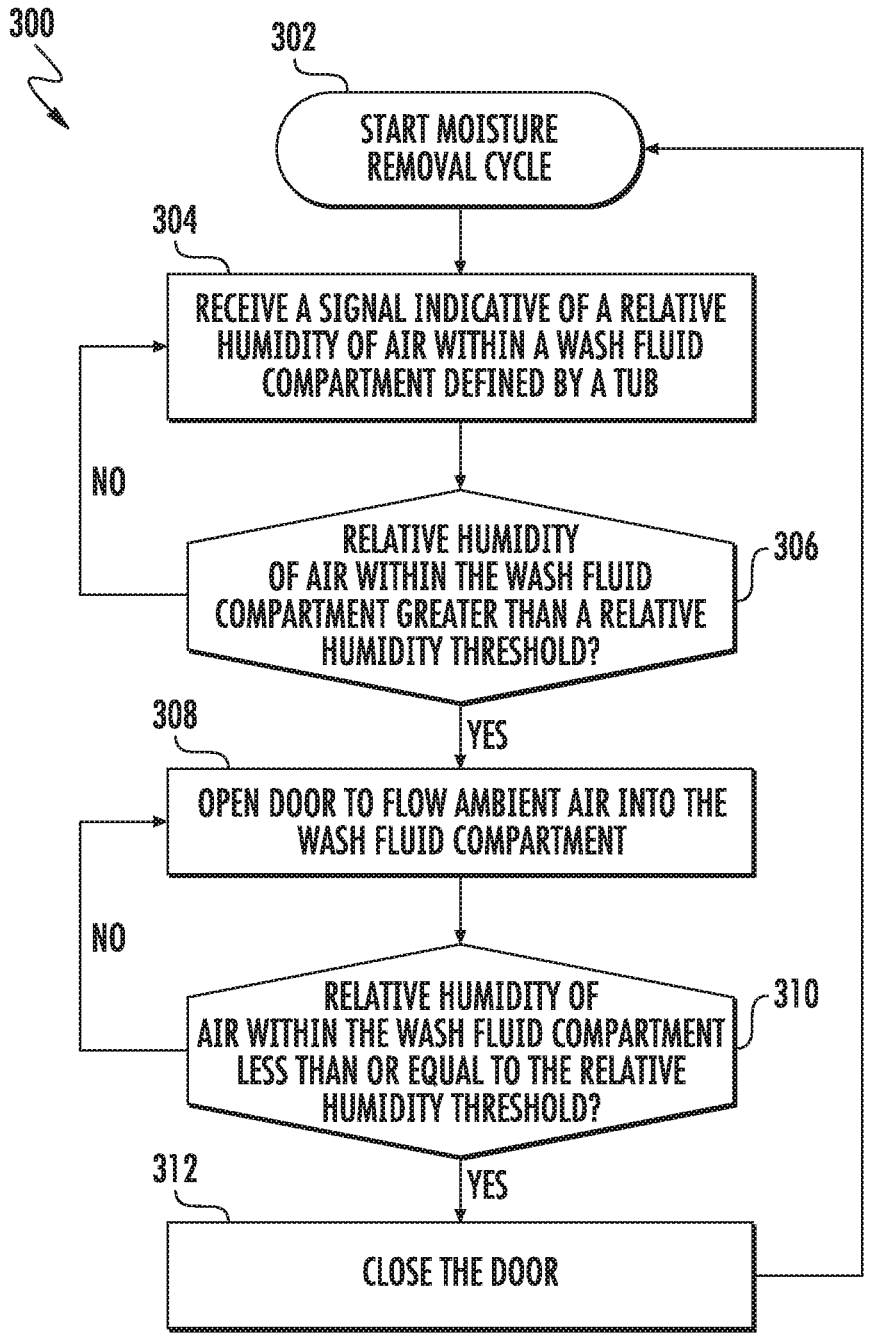
FIG. 4 provides an exemplary method for operating a washing machine appliance in a moisture removal cycle according to an exemplary embodiment of the present disclosure.

FIG. 4 provides an exemplary method (300) for operating a washing machine appliance in a moisture removal cycle according to an exemplary embodiment of the present disclosure. In this way, moisture trapped within a wash chamber compartment may be removed. If articles are present in the wash chamber, moisture may likewise be removed from the articles. Method (300) can be implemented using any suitable appliance, including for example, horizontal axis washing machine appliance 100 of FIGS. 1 through 3. Accordingly, to provide context to method (300), reference numerals utilized to describe the features of washing machine appliance 100 in FIGS. 1 through 3 will be used below.

At (302), method (300) includes commencing the moisture removal cycle. As will be understood, the moisture removal cycle may be performed after or between wash cycles of washing machine appliance 100. The moisture removal cycle may be commenced in a number of suitable ways. For instance, a user may manually commence the moisture removal cycle. For example, a user may manipulate one or more input selectors 110 of control panel 108. As another example, a user may activate the moisture removal cycle by utilizing an application on a remote user device communicatively coupled with controller 180 of washing machine appliance 100. Another suitable manner for commencing the moisture removal cycle includes automatically commencing the moisture removal cycle. For example, the moisture removal cycle may be commenced automatically at a predetermined interval, such as e.g., every week, every month, etc. In this manner, the moisture removal cycle may be performed without user interaction with washing machine appliance 100 and it may be ensured that wash fluid compartment 119 is "dried out" at regular intervals. As another example, the moisture removal cycle may be commenced automatically after a wash cycle is performed. In this way, the moisture-laden articles disposed within wash fluid compartment 119 may begin drying immediately after the completion of a wash cycle. Yet another suitable manner for commencing the moisture removal cycle includes embedding the moisture removal cycle into another cycle, such as e.g., a basket clean cycle in which the basket 120 is self-cleaned. The embedded moisture removal cycle may be performed after the basket clean cycle, for example. In this way, when such other cycles are selected by a user or run automatically by washing machine appliance 100, the moisture removal cycle is likewise performed.

At (304), method (300) includes receiving a signal indicative of a relative humidity of the air within a wash fluid compartment defined by a tub of a washing machine appliance. For instance, humidity sensor 198 may generate one or more signals based on the moisture level within wash fluid compartment 119 and such signals indicative of the relative humidity of the air within wash fluid compartment 119 may be routed to controller 180. Based on the signals received, controller 180 may determine the relative humidity of the air within wash fluid compartment 119.

At (306), method (300) includes determining whether the relative humidity of air within the wash fluid compartment is greater than a relative humidity threshold based at least in part on the signal. Once controller 180 receives the signal and determines the relative humidity of the air within wash fluid compartment 119, controller 180 compares the relative humidity of the air within wash fluid compartment 119 with a relative humidity threshold. The relative humidity threshold may be a fixed value, e.g., forty-five percent (45%), or may be a user defined and adjustable parameter. As one example, suppose the relative humidity threshold is set at fifty percent (50%) and that the relative humidity of the air within wash fluid compartment 119 is seventy percent (70%). As seventy percent (70%) is greater than fifty percent (50%), the relative humidity of air within wash fluid compartment 119 is deemed greater than the relative humidity threshold. In yet other implementations, the relative humidity threshold is set as the relative humidity of the ambient air external to the wash fluid compartment 119.

For this exemplary implementation, if at (306) it is determined that the relative humidity of the air within wash fluid compartment 119 is greater than the relative humidity threshold, then method (300) proceeds to (308). If, however, it is determined that the relative humidity of the air within wash fluid compartment 119 is not greater than the relative humidity threshold, then method (300) loops to (304) where so that controller 180 can continue monitoring the relative humidity within wash fluid compartment 119.

At (308), method (300) includes opening, if the relative humidity of air within the wash fluid compartment is greater than the relative humidity threshold, a door of the washing machine appliance to an open position to flow ambient air into the wash fluid compartment. For instance, in some exemplary implementations, once controller 180 determines that the relative humidity of the air within wash fluid compartment 119 is greater than the relative humidity threshold at (308), controller 180 activates motor 101 to drive a lid or door 112 of washing machine appliance 100 to an open position. Door 112 may be opened to any suitable open position. As one example, door 112 may be opened an arc length of about two (2) inches from its closed position. As another example, door 112 may be opened an arc length of about four (4) inches from its closed position. As yet another example, door 112 may be opened about thirty degrees (30°) with respect to the closed position (i.e., a zero degree (0°) position) as depicted in FIG. 2. In yet other embodiments, door 112 may be moved to an open position that is based at least in part on the delta between the relative humidity of air within the wash fluid compartment and the relative humidity threshold. For instance, the bigger or greater the delta, the more open door 112 is positioned. In contrast, the smaller the delta, the less open door 112 is positioned. A look up table may be used to correlate the delta with the open position.

When door 112 is opened, the drier and relatively high pressure ambient air flows into wash fluid compartment 119. As this occurs, the moist and relatively low pressure air within wash fluid compartment 119 is displaced from wash fluid compartment 119 by the ambient air. In this way, by opening door 112, washing machine appliance 100 may passively remove moisture from wash fluid compartment 119. That is, moisture may be removed from wash fluid compartment 119 without actively forcing the moist air out of wash fluid compartment 119; rather, the moist air is circulated out of wash fluid compartment 119 based on the pressure differential between the relatively high pressure ambient air and the relatively low pressure air within wash fluid compartment 119.

In some implementations, however, if the relative humidity of the air within the wash fluid compartment is greater than the relative humidity threshold as determined at (306), the method (300) further includes activating a fan to facilitate the movement of the air within the wash fluid compartment. In this way, in addition to the passive air/moisture exchange created by opening door 112, the moist air within wash fluid compartment 119 may be forced toward door 112 and out of wash fluid compartment 119. For instance, as shown in FIG. 3, controller 180 may activate sealable damper 193 to move to an open position and may activate fan 195 to flow air from rear 134 of tub 114 toward door 112, e.g., along the transverse direction T. In this way, the moist, relatively low pressure air may be forced out of wash fluid compartment 119 through open door 112. In addition, fan 195 may draw in ambient air through opening 197 and along fluid supply conduit 196. Such ambient air may further displace the moist air from wash fluid compartment 119 and out open door 112.

Further, in some exemplary implementations, prior to opening door 112 at (308), method (300) includes receiving a signal indicative of a relative humidity of ambient air external to the wash fluid compartment. As one example, ambient humidity sensor 199 may generate one or more signals indicative of the relative humidity of the air within wash fluid compartment 119 and such signals indicative of the relative humidity of the ambient air external to fluid compartment 119 may be routed to and received by controller 180. Based on the signals received, controller 180 may determine the relative humidity of the ambient air within wash fluid compartment 119. As another example, washing machine appliance 100 may not include a sensor configured to sense the relative humidity of the ambient air but may receive a signal indicative of the relative humidity of ambient air from a remote source. For instance, in some implementations, the signal indicative of the relative humidity of ambient air external to the wash fluid compartment is received from a remote computing system over a network. The computing system may be include one or more computing devices configured to monitor and receive signals indicative of the relative humidity of the ambient air in the geographical region in which washing machine appliance 100 is situated. For instance, the computing system may be a computing system operated by a weather service. Signals indicative of the relative humidity of the ambient air in the geographic region may be routed to a network interface of controller 180 and controller 180 may process the signals to determine the relative humidity of the ambient air. The network can be any suitable type of network, such as a local area network (e.g., intranet), wide area network (e.g., internet), low power wireless networks [e.g., Bluetooth Low Energy (BLE)], cellular network (e.g., GSM, CDMA, etc.), or some combination thereof and can include any number of wired or wireless links. In general, communication over the network can be carried via any type of wired or wireless connection, using a wide variety of communication protocols (e.g., TCP/IP, HTTP, SMTP, FTP), encodings or formats (e.g., HTML, XML), or protection schemes (e.g., VPN, secure HTTP, SSL). As another example, the remote source may be a remotely mounted humidity sensor.

Further, in such implementations, after receiving signals indicative of a relative humidity of the ambient air external to the wash fluid compartment, method (300) includes determining whether the relative humidity of the air within the wash fluid compartment is greater than the relative humidity of the ambient air external to the wash fluid compartment. Once controller 180 receives the one or more signals and determines the relative humidity of the ambient air external to wash fluid compartment 119, controller 180 compares the relative humidity of the air within wash fluid compartment 119 with the relative humidity of the ambient air external to the wash fluid compartment. If it is determined that the relative humidity of the air within wash fluid compartment 119 is greater than the relative humidity of the ambient air external to the wash fluid compartment, then door 112 is opened at (308). However, if the relative humidity of the air within wash fluid compartment 119 is not greater than the relative humidity of the ambient air external to the wash fluid compartment, then door 112 is not opened at (308). That is, door 112 remains closed and method (300) loops back to (302). Door 112 remains closed so that the moist ambient air is prevented from flowing into wash fluid compartment 119.

In yet further implementations, to prevent children, pets, or others from gaining access to wash fluid compartment 119 when door 112 is in the open position during a moisture removal cycle, method (300) includes locking the door in a fixed position. For instance, motor 101 may include an internal locking mechanism that may prevent door 112 from being rotated about its hinge axis, e.g., about the vertical direction V. In this way, a child or pet cannot further open door 112 to gain access thereto. As one example, motor 101 may include an internal locking mechanism that prevents rotation of door 112 up to fifty pounds of force (50 lbf). As another example, motor 101 may include an internal locking mechanism that prevents rotation of door 112 up to thirty pounds of force (30 lbf).

At (310), after opening at (308), method (300) includes determining whether the relative humidity of the air within the wash fluid compartment is less than or equal to the relative humidity threshold. Further signals indicative of the relative humidity of the air within the wash fluid compartment may be received so that such determination can be made at (310). With door 112 in the open position, the relative humidity of the air within the wash fluid compartment 119 begins to drop as relatively drier and high pressure air flows into wash fluid compartment 119 to displace the moist, relatively low pressure air within wash fluid compartment 119. Eventually, the relative humidity of the air within wash fluid compartment 119 will drop below the relative humidity threshold (if set appropriately) and will stabilize approximately at the relative humidity of the ambient air. At (310), controller 180 monitors whether the relative humidity of the air within the wash fluid compartment has dropped below or is equal to the relative humidity threshold. For this exemplary implementation, if at (310) it is determined that the relative humidity of the air within wash fluid compartment 119 is less than or equal to the relative humidity threshold, then method (300) proceeds to (312) and door 112 is closed. If, however, it is determined that the relative humidity of the air within wash fluid compartment 119 is not less than or equal to the relative humidity threshold, then method (300) loops to (308) so that door 112 can remain open to flow ambient air into wash fluid compartment 119. Accordingly, for this implementation, method (300) iterates between (308) and (310) until the relative humidity of the air within wash fluid compartment 119 is less than or equal to the relative humidity threshold.

At (312), method (300) includes closing, if the relative humidity of air within the wash fluid compartment is less than or equal to the relative humidity threshold, the door of the washing machine appliance. Once door 112 is closed, method (300) loops to (302) and commences once again. In yet other embodiments, once door 112 is closed at (312), method (300) ends until a user or washing machine appliance 100 initiates another moisture removal cycle.

In some alternative implementations, after opening at (308), method (300) includes closing the door of the washing machine appliance if the door has been opened for a predetermined open time. As one example, the predetermined open time may be five (5) hours, ten (10) hours, fifteen (15) hours, etc. By opening door 112 for a predetermined open time, controller 180 need not continually monitor the relative humidity of the air within the wash fluid compartment 119. In this way, controller 180 processing resources may be reserved for other tasks.

In yet further implementations, method (300) includes notifying a user that the moisture removal cycle has been performed. As one example, washing machine appliance 100 may include a speaker that audibly communicates the notification to a user. As another example, washing machine appliance 100 may include a communication interface that is operably connected with controller 180. The communication interface may include a network interface that provides for communication over a network, such as e.g., a wireless network. In such implementations, washing machine appliance 100 may send notifications to a user's mobile device, such as e.g., a cell phone. In further implementations, additionally or alternatively, method (300) includes logging a moisture removal cycle count. In this way, for example, if washing machine appliance 100 is serviced, an operator, service professional, or consumer may quickly ascertain how often moisture was removed from washing machine appliance 100 over its service life.

Figure 5:
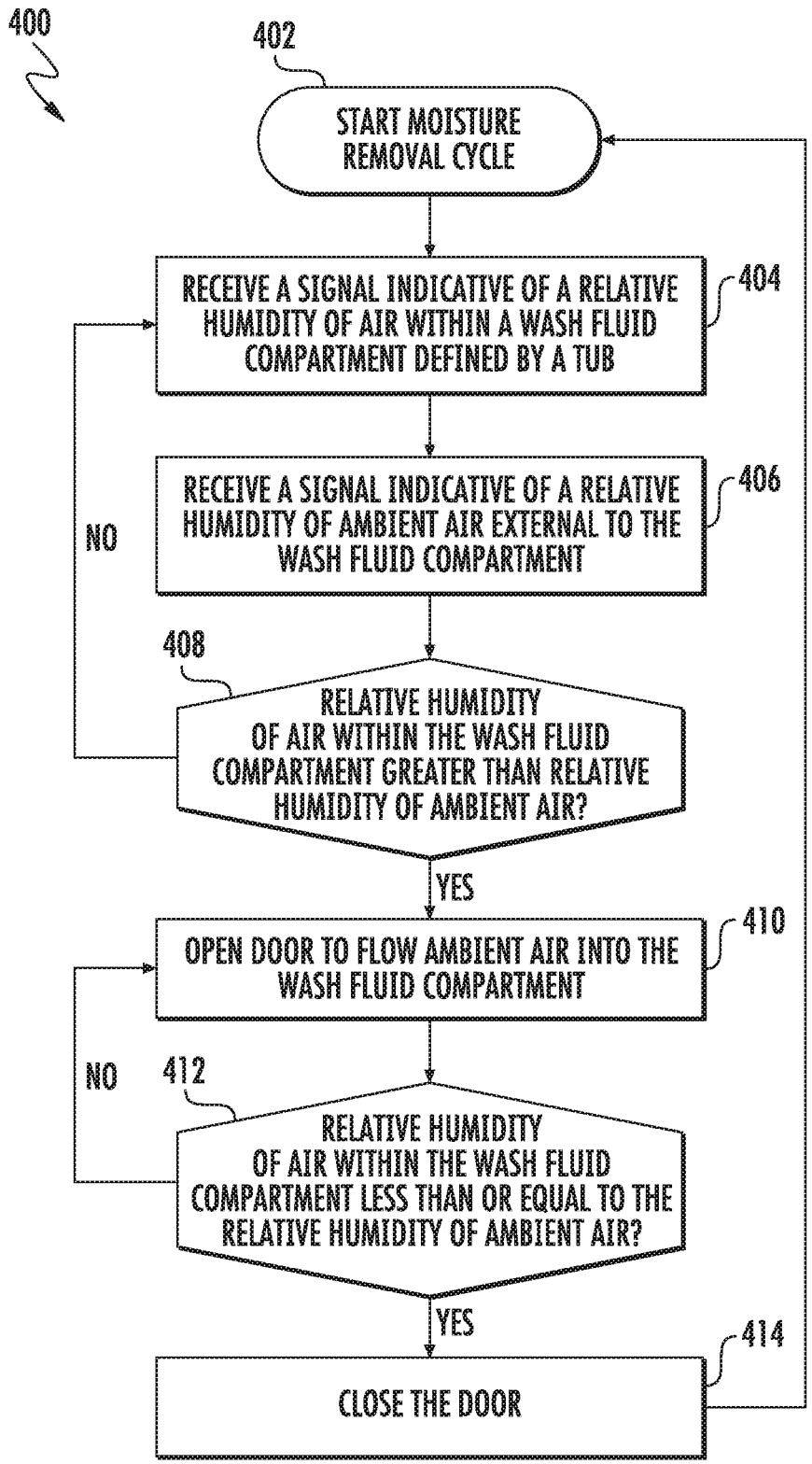
FIG. 5 provides another exemplary method for operating a washing machine appliance in a moisture removal cycle according to an exemplary embodiment of the present disclosure.

FIG. 5 provides another exemplary method (400) for operating a washing machine appliance in a moisture removal cycle according to an exemplary embodiment of the present disclosure. In this way, moisture trapped within a wash chamber compartment and articles therein may be removed. Method (400) can be implemented using any suitable appliance, including for example, horizontal axis washing machine appliance 100 of FIGS. 1 through 3. Accordingly, to provide context to method (400), reference numerals utilized to describe the features of washing machine appliance 100 in FIGS. 1 through 3 will be used below.

At (402), method (400) includes commencing the moisture removal cycle. As will be understood, the moisture removal cycle may be performed after or between wash cycles of washing machine appliance 100. The moisture removal cycle may be commenced in a number of suitable ways. For instance, method (400) may be commenced at (402) in any of the ways set forth at (302) of method (300) above.

At (404), method (400) includes receiving a signal indicative of a relative humidity of air within a wash fluid compartment defined by a tub. For instance, humidity sensor 198 may generate one or more signals based on the moisture level within wash fluid compartment 119 and such signals indicative of the relative humidity of the air within wash fluid compartment 119 may be routed to controller 180. Based on the signals received, controller 180 may determine the relative humidity of the air within wash fluid compartment 119.

At (406), method (400) includes receiving a signal indicative of a relative humidity of ambient air external to the wash fluid compartment. As one example, ambient humidity sensor 199 may generate one or more signals indicative of the relative humidity of the air within wash fluid compartment 119 and such signals indicative of the relative humidity of the ambient air external to fluid compartment 119 may be routed to and received by controller 180. Based on the signals received, controller 180 may determine the relative humidity of the ambient air within wash fluid compartment 119. Additionally or alternatively, the signal indicative of the relative humidity of the ambient air may be received from a remote source, e.g., such as the computing system explained previously with respect to method (300).

At (408), method (400) includes determining whether the relative humidity of air within the wash fluid compartment is greater than the relative humidity of ambient air external to the wash fluid compartment. That is, after receiving the signals at (404) and (406) and determining the relative humidity of the air within wash fluid compartment 119 and the relative humidity of the ambient air external to wash fluid compartment 119, controller 180 compares the relative humidity of the air within wash fluid compartment 119 with the relative humidity of the ambient air external to the wash fluid compartment 119. If it is determined that the relative humidity of the air within wash fluid compartment 119 is greater than the relative humidity of the ambient air external to the wash fluid compartment, then door 112 is opened at (410). However, if the relative humidity of the air within wash fluid compartment 119 is less than or equal to the relative humidity of the ambient air external to the wash fluid compartment, then door 112 is not opened at (410). That is, door 112 remains closed and method (400) loops back to (404). Door 112 remains closed so that the moist ambient air is prevented from flowing into wash fluid compartment 119.

At (410), method (400) includes opening, if the relative humidity of the air within the wash fluid compartment is greater than the relative humidity of the ambient air external to the wash fluid compartment, a door of the washing machine appliance to an open position to flow ambient air into the wash fluid compartment. For instance, in some exemplary implementations, once controller 180 determines that the relative humidity of the air within wash fluid compartment 119 is greater than the relative humidity of the ambient air external to the wash fluid compartment at (408), controller 180 activates motor 101 to drive a lid or door 112 of washing machine appliance 100 to an open position. Door 112 may be opened to any suitable position open position. As noted previously, when door 112 is opened, the drier and relatively high pressure ambient air flows into wash fluid compartment 119. As this occurs, the moist and relatively low pressure air within wash fluid compartment 119 is displaced from wash fluid compartment 119 by the ambient air. In this way, by opening door 112, washing machine appliance 100 may passively remove moisture from wash fluid compartment 119. Additionally, in some implementations, fan 195 may be activated by controller 180 to facilitate removing the moist air within wash fluid compartment 119, as described previously. In yet further implementations, method (300) includes locking the door in a fixed open position. For instance, as noted previously, motor 101 may include an internal locking mechanism that may prevent door 112 from being rotated about its hinge axis, e.g., about the vertical direction V. In this way, a child or pet cannot further open door 112 to gain access thereto.

At (412), method (400) includes determining whether the relative humidity of air within the wash fluid compartment is less than or equal to the relative humidity of ambient air external to the wash fluid compartment. At (412), controller 180 monitors whether the relative humidity of the air within the wash fluid compartment is equal to or below the relative humidity of the ambient air external to wash fluid compartment 119. For this exemplary implementation, if at (412) it is determined that the relative humidity of the air within wash fluid compartment 119 is less than or equal to the relative humidity of the ambient air external to wash fluid compartment 119, then method (400) proceeds to (414) and door 112 is closed. If, however, it is determined that the relative humidity of the air within wash fluid compartment 119 is not less than or equal to the relative humidity of the ambient air external to wash fluid compartment 119, then method (400) loops to (410) so that door 112 can remain open to flow ambient air into wash fluid compartment 119. Accordingly, for this implementation, method (400) iterates between (410) and (412) until the relative humidity of the air within wash fluid compartment 119 is less than or equal to the relative humidity of the ambient air external to wash fluid compartment 119.

At (414), method (400) includes closing, if the relative humidity of the air within the wash fluid compartment is less than or equal to the relative humidity of the ambient air external to the wash fluid compartment, the door of the washing machine appliance. Once door 112 is closed, method (400) loops to (402) and commences once again. In yet other embodiments, once door 112 is closed at (414), method (400) ends until a user or washing machine appliance 100 initiates another moisture removal cycle.

In some alternative implementations, after opening at (410), method (400) includes closing the door of the washing machine appliance if the door has been opened for a predetermined open time. By opening door 112 for a predetermined open time, controller 180 need not continually monitor the relative humidity of the air within the wash fluid compartment 119. In this way, controller 180 processing resources may be reserved for other tasks.

In yet further implementations, method (400) includes notifying a user that the moisture removal cycle has been performed. A user may be notified in any suitable manner, such as the ways described above with reference to method (300). In further implementations, additionally or alternatively, method (400) includes logging a moisture removal cycle count. In this way, for example, if washing machine appliance 100 is serviced, an operator, service professional, or consumer may quickly ascertain how often moisture was removed from washing machine appliance 100 over its service life.

Figure 6:
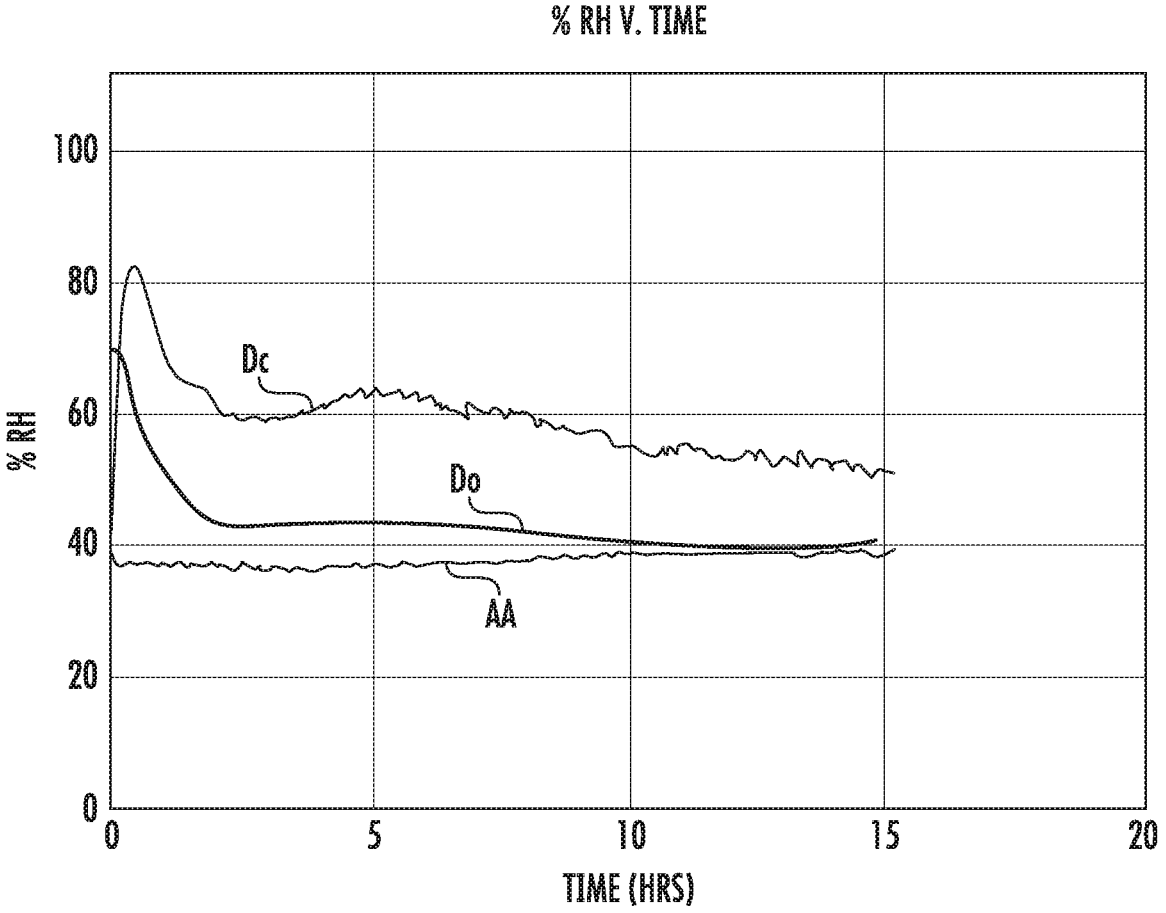
FIG. 6 graphically depicts the advantages of operating a washing machine appliance in a moisture removal cycle.

FIG. 6 graphically depicts the advantages of operating a washing machine appliance in a moisture removal cycle. More particularly, FIG. 6 graphically depicts a comparison between a function $D_C$ in which a moisture removal cycle was not performed by washing machine appliance and a function $D_O$ in which a moisture removal cycle was performed by washing machine appliance. Thus, for function $D_C$, the door of the washing machine appliance remained in a closed position, and for function $D_O$, the door of the washing machine appliance was opened just after the completion of a wash cycle. Function $D_C$ and function $D_O$ each depict the relative humidity of the air within a wash fluid compartment of their respective washing machine appliances plotted as a function of time after the respective washing machine appliances performed wash cycles. The relative humidity of the ambient air external to the wash fluid compartment, denoted AA, is also shown.

As shown in FIG. 6, for function $D_C$ in which the door of the washing machine remained closed, at time zero (0), the moisture levels within the wash fluid compartment increased such that the relative humidity (RH) was just above eighty percent (80%). At five (5) hours after completion of the wash cycle, the RH of the air within the wash fluid compartment decreased to just over sixty percent (60%). The RH continued to decrease to about fifty-five percent (55%) at ten (10) hours and eventually to about fifty percent (50%) RH at fifteen (15) hours. As depicted, at fifteen (15) hours after completion of the wash cycle, the RH of the air within the wash fluid compartment was still about ten percent (10%) greater than the RH of the ambient air AA.

For function $D_O$ in which the door of the washing machine was opened just after the completion of the wash cycle, the RH of the air within the wash fluid compartment decreased relatively rapidly compared to the RH of function $D_C$. As shown, between hour zero (0) and two and a half (2.5) hours after completion of the wash cycle, the RH decreased from about seventy percent (70%) RH to about forty-five percent (45%) RH. After about two and a half (2.5) hours, the RH of the air within the wash fluid compartment of the $D_O$ function gradually decreased until it stabilized proximate the ambient air AA at about twelve and a half (12.5) hours after completion of the wash cycle. In comparing the $D_O$ function with the $D_C$ function, the RH of the air within the wash fluid compartment for the $D_O$ function (the function representative of the moisture removal cycle) converges toward the RH of the ambient air AA relatively rapidly and stabilizes near the RH of the ambient air AA prior to the fifteen (15) hour mark. On the other hand, the RH of the air within the wash fluid compartment for the $D_C$ function (the function representative no moisture removal cycle performed by washing machine appliance) was unable to obtain or stabilize proximate the RH of the ambient air AA prior to or at the fifteen (15) hour mark. Thus, as made clear by the graph of FIG. 6, performing a moisture removal cycle in which the door or lid of washing machine appliance is moved to an open position advantageously removes moisture from the wash fluid compartment, and thus, mold, mildew, and foul odors stemming from the washing machine appliance are less likely.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance in a moisture removal cycle, the method comprising:

receiving a signal indicative of a relative humidity of air within a wash fluid compartment defined by a tub;

determining whether the relative humidity of air within the wash fluid compartment is greater than a relative humidity threshold based at least in part on the signal; and opening, if the relative humidity of air within the wash fluid compartment is greater than the relative humidity threshold, a door of the washing machine appliance to an open position to flow ambient air into the wash fluid compartment, wherein opening the door comprises activating a motor to drive the door to the open position.

2. The method of claim 1, wherein after opening, the method further comprises:

determining whether the relative humidity of air within the wash fluid compartment is less than or equal to the relative humidity threshold; and closing, if the relative humidity of air within the wash fluid compartment is less than or equal to the relative humidity threshold, the door of the washing machine appliance.

3. The method of claim 1, wherein after opening, the method further comprises:

closing the door of the washing machine appliance if the door has been opened for a predetermined open time.

4. The method of claim 1, wherein if the relative humidity of air within the wash fluid compartment is greater than the relative humidity threshold, the method further comprises:

activating a fan to facilitate the movement of air within the wash fluid compartment.

5. The method of claim 1, further comprising:

receiving a signal indicative of a relative humidity of ambient air external to the wash fluid compartment;

determining whether the relative humidity of air within the wash fluid compartment is greater than the relative humidity of ambient air external to the wash fluid compartment;

wherein the door of the washing machine appliance is opened if the relative humidity of air within the wash fluid compartment is greater than the relative humidity of ambient air external to the wash fluid compartment.

6. The method of claim 5, wherein the signal indicative of the relative humidity of ambient air external to the wash fluid compartment is received from an ambient humidity sensor mounted to the washing machine appliance.

7. The method of claim 5, wherein the signal indicative of the relative humidity of ambient air external to the wash fluid compartment is received from a remote computing device over a network or a remotely mounted humidity sensor.

8. The method of claim 1, further comprising:

commencing the moisture removal cycle, wherein commencing the moisture removal cycle comprises activating the moisture removal cycle with a user device communicatively coupled with a controller of the washing machine appliance.

9. A washing machine appliance configured for performing a moisture removal cycle, the washing machine appliance comprising:

a cabinet;

a tub disposed within the cabinet and defining a wash fluid compartment;

a basket rotatably mounted within the tub, the basket defining a wash chamber for receipt of articles for washing;

a lid coupled with the cabinet and movable between an open position and a closed position for selectively providing access to the wash chamber;

a motor operatively coupled with the lid and configured for moving the lid between the open position and the closed position;

a humidity sensor mounted to the washing machine appliance within the wash fluid compartment;

a controller in operative communication with the motor and the humidity sensor, the controller configured to:

receive a signal from the humidity sensor that is indicative of a relative humidity of air within the wash fluid compartment;

determine whether the relative humidity of air within the wash fluid compartment is greater than a relative humidity threshold; and activate, if the relative humidity of air within the wash fluid compartment is greater than the relative humidity threshold, the motor to move the lid to the open position to flow ambient air into the wash fluid compartment.

10. The washing machine appliance of claim 9, wherein the washing machine appliance is a horizontal axis washing machine appliance or a vertical axis washing machine appliance.

11. The washing machine appliance of claim 9, wherein the relative humidity threshold is set as a relative humidity of ambient air external to the wash fluid compartment.

12. The washing machine appliance of claim 9, wherein the controller is further configured to:

activate the motor to close the lid of the washing machine appliance if the lid has been opened for a predetermined open time.

13. The washing machine appliance of claim 9, wherein the controller is further configured to:

activate the motor to close the lid of the washing machine appliance if the relative humidity of air within the wash fluid compartment is less than or equal to the relative humidity threshold.

14. The washing machine appliance of claim 9, wherein the controller is further configured to:

activate the motor to lock the lid in a fixed position when the lid is moved to the open position.

15. The washing machine appliance of claim 9, further comprising:

a fan, and wherein the controller is further configured to activate the fan to facilitate the movement of air within the wash fluid compartment when the motor is activated to move the lid to the open position to flow ambient air into the wash fluid compartment.

16. A method for operating a washing machine appliance in a moisture removal cycle, the method comprising:

receiving a signal indicative of a relative humidity of air within a wash fluid compartment defined by a tub;

receiving a signal indicative of a relative humidity of ambient air external to the wash fluid compartment;

determining whether the relative humidity of air within the wash fluid compartment is greater than the relative humidity of ambient air external to the wash fluid compartment; and opening, if the relative humidity of air within the wash fluid compartment is greater than the relative humidity of ambient air external to the wash fluid compartment, a door of the washing machine appliance to an open position to flow ambient air into the wash fluid compartment, wherein opening the door comprises activating a motor to drive the door to the open position.

17. The method of claim 16, wherein after opening, the method further comprises:

determining whether the relative humidity of air within the wash fluid compartment is less than or equal to the relative humidity of ambient air external to the wash fluid compartment; and closing, if the relative humidity of air within the wash fluid compartment is less than or equal to the relative humidity of ambient air external to the wash fluid compartment, the door of the washing machine appliance.

18. The method of claim 16, wherein after opening the door, the method further comprises:

locking the door in a fixed position utilizing the motor.

* * * * *